US008079821B2

(12) United States Patent
Campbell et al.

(10) Patent No.: US 8,079,821 B2
(45) Date of Patent: Dec. 20, 2011

(54) TURBINE AIRFOIL WITH DUAL WALL FORMED FROM INNER AND OUTER LAYERS SEPARATED BY A COMPLIANT STRUCTURE

(75) Inventors: Christian X. Campbell, Oviedo, FL (US); Jay A. Morrison, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 414 days.

(21) Appl. No.: 12/435,684

(22) Filed: May 5, 2009

(65) Prior Publication Data

US 2010/0284798 A1 Nov. 11, 2010

(51) Int. Cl.
*F01D 5/18* (2006.01)

(52) U.S. Cl. ..... 416/232; 416/96 A; 416/97 R; 416/231 R; 415/115

(58) Field of Classification Search ..... 415/114–116; 416/96 A, 96 R, 97 R, 193 A, 229 R, 231 R, 416/232, 233, 236 R
See application file for complete search history.

(56) References Cited

U.S. PATENT DOCUMENTS 4,203,706 A * 5/1980 Hess ..... 416/97 A
5,328,331 A * 7/1994 Bunker et al. ..... 416/96 R
5,383,766 A * 1/1995 Przirembel et al. ..... 416/97 A
5,484,258 A * 1/1996 Isburgh et al. ..... 415/115
5,931,638 A * 8/1999 Krause et al. ..... 416/97 R
6,261,054 B1 7/2001 Bunker et al.
6,318,963 B1 * 11/2001 Emery et al. ..... 416/96 A
6,533,547 B2 3/2003 Anding et al.
6,808,367 B1 10/2004 Liang
7,028,747 B2 4/2006 Widrig et al.
7,033,136 B2 4/2006 Botrel et al.
7,371,049 B2 * 5/2008 Cunha et al. ..... 416/97 A
7,544,044 B1 * 6/2009 Liang ..... 416/96 R
7,695,246 B2 * 4/2010 Cunha et al. ..... 416/97 R
2002/0182056 A1 * 12/2002 Widrig et al. ..... 415/114
2005/0135922 A1 * 6/2005 Cherolis et al. ..... 415/115
2006/0120870 A1 * 6/2006 Trindade et al. ..... 416/97 R
2008/0019839 A1 * 1/2008 Cunha et al. ..... 416/96 R
2008/0170944 A1 * 7/2008 Propheter-Hinckley .. 416/229 R
2009/0028703 A1 * 1/2009 Devore et al. ..... 416/1
2009/0180861 A1 * 7/2009 Trindade et al. ..... 415/115
2010/0247327 A1 * 9/2010 Malecki et al. ..... 416/96 A

* cited by examiner

*Primary Examiner* — Michael Lebentritt

(57) ABSTRACT

A turbine airfoil usable in a turbine engine with a cooling system and a compliant dual wall configuration configured to enable thermal expansion between inner and outer layers while eliminating stress formation is disclosed. The compliant dual wall configuration may be formed a dual wall formed from inner and outer layers separated by a compliant structure. The compliant structure may be configured such that the outer layer may thermally expand without limitation by the inner layer. The compliant structure may be formed from a plurality of pedestals positioned generally parallel with each other. The pedestals may include a first foot attached to a first end of the pedestal and extending in a first direction aligned with the outer layer, and may include a second foot attached to a second end of the pedestal and extending in a second direction aligned with the inner layer.

20 Claims, 5 Drawing Sheets

TURBINE AIRFOIL WITH DUAL WALL FORMED FROM INNER AND OUTER LAYERS SEPARATED BY A COMPLIANT STRUCTURE

STATEMENT REGARDING FEDERALLY SPONSORED RESEARCH

Development of this invention was supported in part by the United States Department of Energy, Contract No. DE-FC26-05NT42644. Accordingly, the United States Government has certain rights in this invention.

FIELD OF THE INVENTION

This invention is directed generally to turbine airfoils, and more particularly to hollow turbine airfoils having cooling channels for passing fluids, such as air, to cool the airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to these high temperatures. As a result, turbine vanes and blades must be made of materials capable of withstanding such high temperatures. In addition, turbine vanes and blades often contain cooling systems for prolonging the life of the vanes and blades and reducing the likelihood of failure as a result of excessive temperatures.

Typically, turbine vanes are formed from an elongated portion forming a vane having one end configured to be coupled to a vane carrier and an opposite end configured to be movably coupled to an inner endwall. The vane is ordinarily composed of a leading edge, a trailing edge, a suction side, and a pressure side. The inner aspects of most turbine vanes typically contain an intricate maze of cooling circuits forming a cooling system. The cooling circuits in the vanes receive air from the compressor of the turbine engine and pass the air through the ends of the vane adapted to be coupled to the vane carrier. The cooling circuits often include multiple flow paths that are designed to maintain all aspects of the turbine vane at a relatively uniform temperature. At least some of the air passing through these cooling circuits is exhausted through orifices in the leading edge, trailing edge, suction side, and pressure side of the vane.

Often times, the outer wall, otherwise referred to as the dual wall, is formed from inner and outer walls. The walls are rigidly coupled together. The outer wall is exposed to hotter temperatures and, as a result, is subject to greater thermal expansion but is rigidly retained by the inner wall. Thus, stress develops between the inner and outer walls.

SUMMARY OF THE INVENTION

This invention relates to a turbine airfoil usable in a turbine engine with a cooling system and a compliant dual wall configuration configured to enable thermal expansion between inner and outer layers while eliminating stress formation. The compliant dual wall configuration may be formed from a dual wall that is formed from inner and outer layers separated by a compliant structure. The compliant structure may be configured such that the outer layer may thermally expand without limitation by the inner layer. The compliant structure may be formed from materials that enable the outer layer, which is exposed to the hot gas path, to thermally expand independent of the inner layer, thereby preventing the accumulation of stress within the dual wall.

The turbine airfoil may be formed from a generally elongated hollow airfoil formed from an outer dual wall having a leading edge, a trailing edge, a pressure side, a suction side, an outer endwall at a first end, an inner endwall at a second end opposite the first end, and a cooling system positioned in the generally elongated airfoil formed by the outer dual wall. The dual wall may be formed from an outer layer and an inner layer separated from the outer layer by a compliant structure that allows the outer and inner layers to move relative to each other thereby reducing the buildup of stress between the layers. The compliant structure may be formed from a plurality of pedestals attached to the outer layer and inner layers and extending nonorthogonally and nonparallel between the two layers. The pedestals may be equally spaced and may include feet facilitating attachment to the outer and inner layers. In one embodiment, the pedestals may be positioned generally parallel with each other and at least one of the pedestals may include a first foot attached to a first end of the pedestal and extending in a first direction aligned with the contact surface of the outer layer and a second foot attached to a second end of the pedestal and extending in a second direction aligned with the contact surface of the inner layer. At least a portion of the pedestals may be positioned at different angles relative to the inner layer thereby creating different thermal growth in distance between the inner layer and the outer layer such that a distance between the outer and inner layers differs along a length of the outer and inner layers.

In other embodiments, the compliant structure may be formed from alternatively shaped structures configured to provide support to the outer layer. The compliant structure may be, but is not limited to, a plurality of pyramidal structures, dual inverted pyramidal structures, a honeycomb structure, a woven wire mesh structure, a honeycomb shaped structure. The outer layer may be formed from materials such as, but not limited to PM2000 and MA756 ODS alloys.

An advantage of this invention is that the compliant structure positioned between the inner and outer layers enables the outer layer to thermally expand greater than the inner layer without the buildup of stress.

Another advantage of this invention is that the outer layer may move laterally in a direction that is generally aligned with the outer layer.

Still another advantage of this invention is that the nonlinear shaped pedestals enable customized thermal expansion of the outer layer in the lateral and radial directions.

Another advantage of this invention is that the pedestals provide cooling channels between the inner and outer layers that enable cooling fluids to be passed therethrough.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
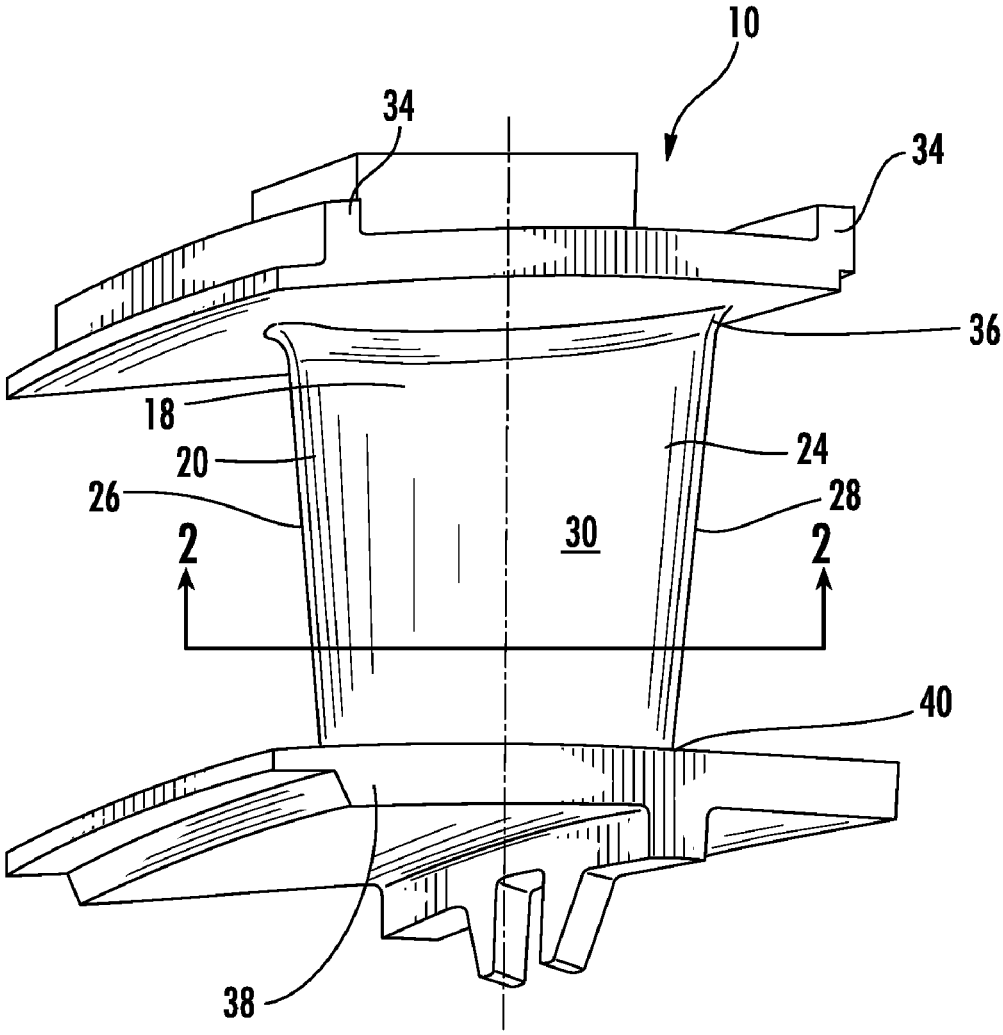
FIG. 1 is a perspective view of a turbine airfoil having features according to the instant invention.
Figure 2:
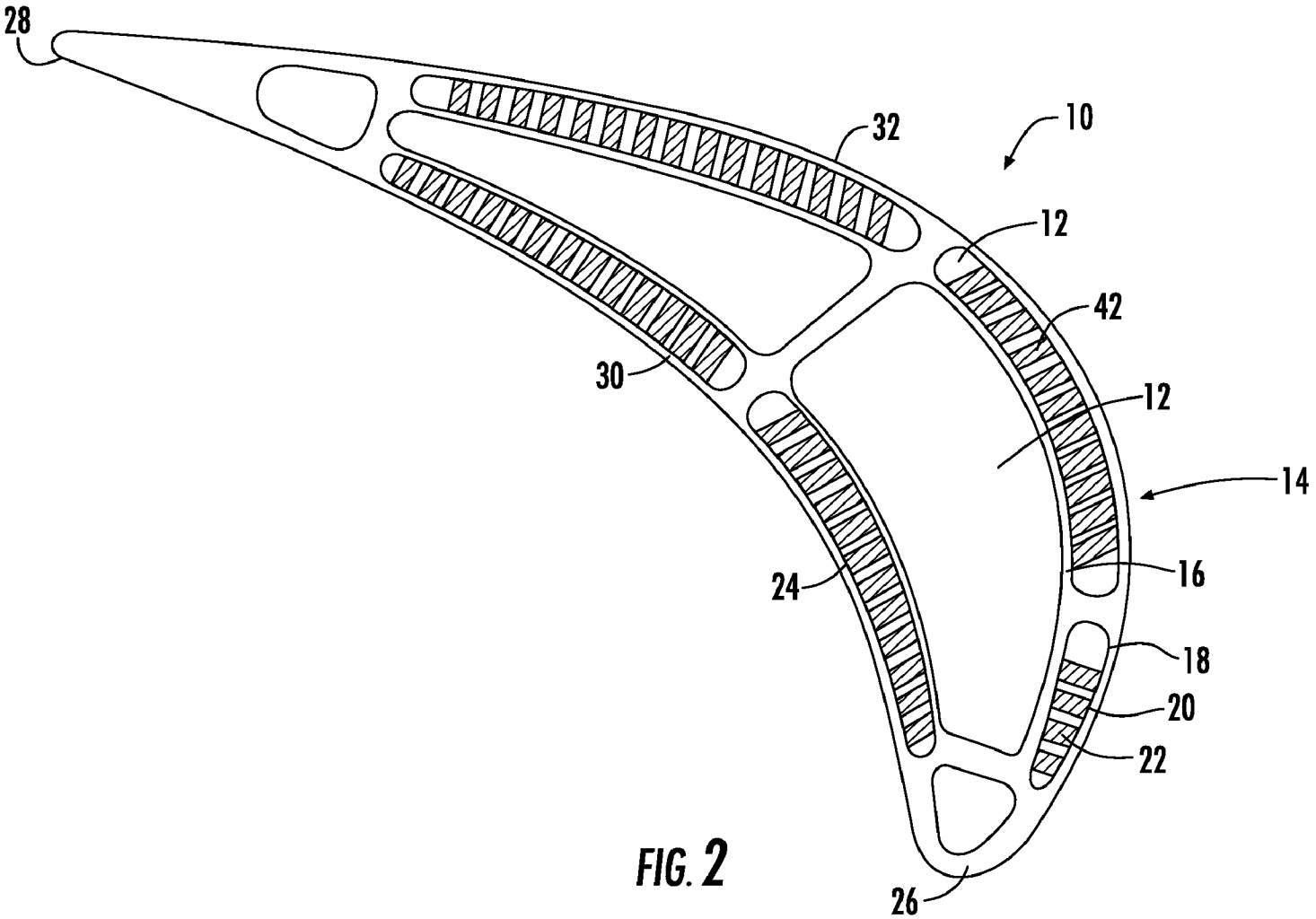
FIG. 2 is a cross-sectional view of the turbine airfoil shown in FIG. 1 taken along line 2-2.
Figure 3:
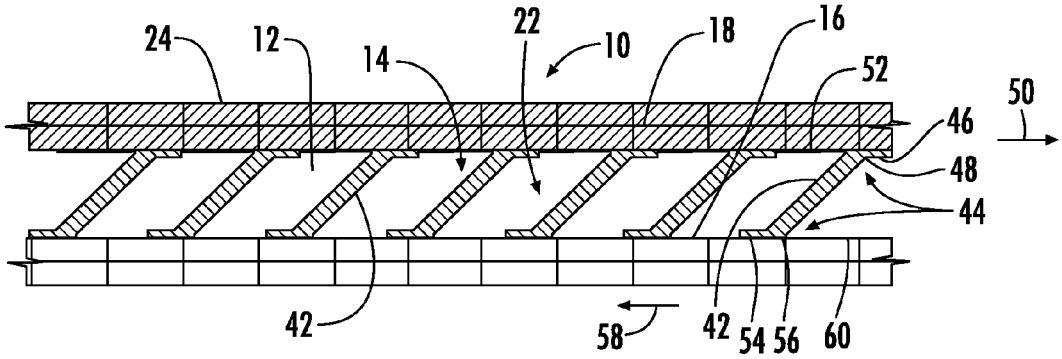
FIG. 3 is a detailed cross-sectional view of the dual wall of FIG. 2 taken at detail 3-3 in FIG. 2.

As shown in FIGS. 1-10, this invention is directed to a turbine airfoil 10 usable in a turbine engine with a cooling system 12 and a compliant dual wall configuration 14 configured to enable thermal expansion between inner and outer layers 16, 18 while eliminating stress formation. The compliant dual wall configuration 14 may also be used in other turbine components 10, such as, but not limited to, transitions, ring segments, shrouds and other hot gas path structures. The compliant dual wall configuration 14 may be formed a dual wall 20 formed from inner and outer layers 16, 18 separated by a compliant structure 22. The compliant structure 22 may be configured such that the outer layer 18 may thermally expand without limitation by the inner layer 16. The compliant structure 22 may be formed from materials that enable the outer layer 18, which is exposed to the hot gas path, to thermally expand independent of the inner layer 16, thereby preventing the accumulation of stress within the dual wall 20.

The turbine airfoil 10 may be formed from a generally elongated hollow airfoil 24 formed from an outer dual wall 20, and having a leading edge 26, a trailing edge 28, a pressure side 30, a suction side 32, an outer endwall 34 at a first end 36, an inner endwall 38 at a second end 40 opposite to the first end 36, and a cooling system 12 positioned in the generally elongated airfoil 24 formed by the outer dual wall 20. In other embodiments, the turbine airfoil 10 may be a turbine blade with a tip at the first end 36 rather than the outer endwall 34. The dual wall 20 may be formed from the outer layer 18 and the inner layer 16 separated from the outer layer 18 by the compliant structure 22 that allows the outer and inner layers 18, 16 to move relative to each other thereby reducing the buildup of stress between the layers 18, 16. The dual wall 20 may form the outer surfaces of the turbine airfoil 10 and may define the outer perimeter of the cooling system 12 positioned within internal aspects of the turbine airfoil 10. The outer layer 18 may be formed from materials such as, but not limited to, PM2000 and MA756 ODS alloys.

Figure 4:
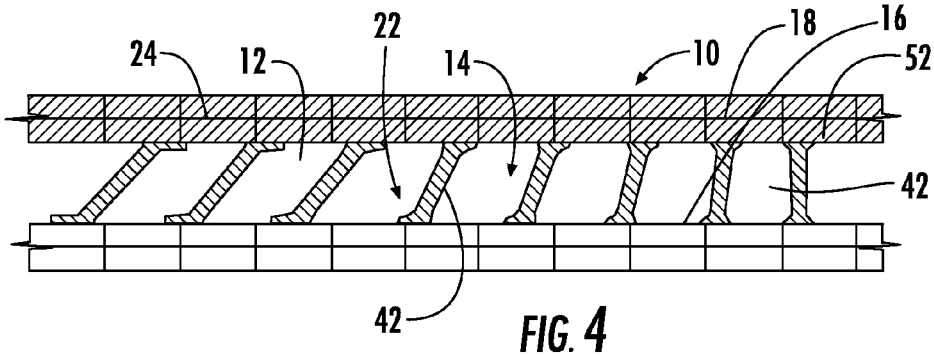
FIG. 4 is a detailed cross-sectional view of an alternative embodiment of the dual wall of FIG. 2 taken at detail 3-3 in FIG. 2.
Figure 5:
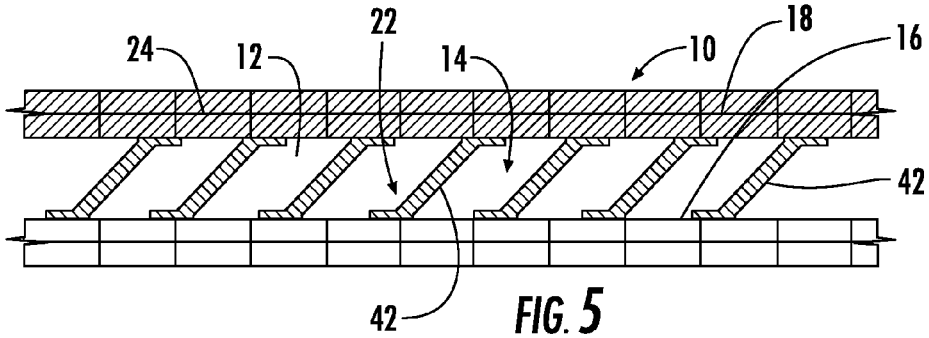
FIG. 5 is a detailed cross-sectional view of the dual wall of FIG. 2 taken at detail 3-3 in FIG. 2 with the outer layer thermally expanded in a direction along the inner layer.

In one embodiment, the compliant structure 22 may be formed from a plurality of pedestals 42, as shown in FIGS. 3-6, attached to the outer layer 18 and inner layers 16 and extending nonorthogonally and nonparallel between the two layers 16, 18. The pedestals 42 may be equally spaced and may include feet 44 facilitating attachment to the outer and inner layers 18, 16. The pedestals 42 may be positioned generally parallel with each other. One or more of the pedestals 42 may include a first foot 46 attached to a first end 48 of the pedestal 42 and extending in a first direction 50 aligned with the contact surface 52 of the outer layer 18 and a second foot 54 attached to a second end 56 of the pedestal 42 and extending in a second direction 58 aligned with the contact surface 60 of the inner layer 16. As such, the pedestals 42 may enable the outer layer 18 to thermally expand in a direction generally along the outer layer 18, as shown in FIG. 5. The pedestals 42 may be configured in a S-shaped configuration. The feet 46, 54 may be generally aligned with each other and nonparallel and nonorthogonal to the body of the pedestal 42.

Figure 6:
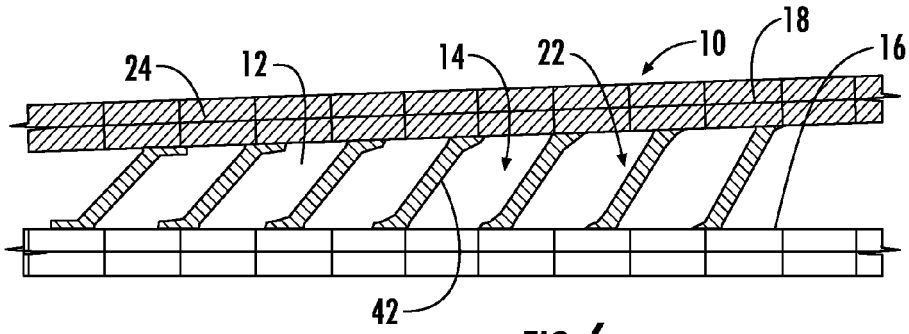
FIG. 6 is a detailed cross-sectional view of the dual wall of FIG. 2 taken at detail 3-3 in FIG. 2 with pedestals positioned in different alignments such that the outer layer thermally expands differently along its length.

In another embodiment, as shown in FIGS. 4 and 6, at least a portion of the pedestals 42 may be positioned at different angles relative to the inner layer 16 thereby creating different thermal growth in distance between the inner layer 16 and the outer layer 18 such that a distance between the outer and inner layers 18, 16 differs along a length of the outer and inner layers 18, 16. Some of the pedestals 42 may be positioned closer to being orthogonal relative to the outer and inner layers 18, 16 than other pedestals 42. The pedestals 42 may be positioned to achieve a desired position of the outer layer 18 relative to the inner layer 16 during turbine operating conditions.

Figure 7:
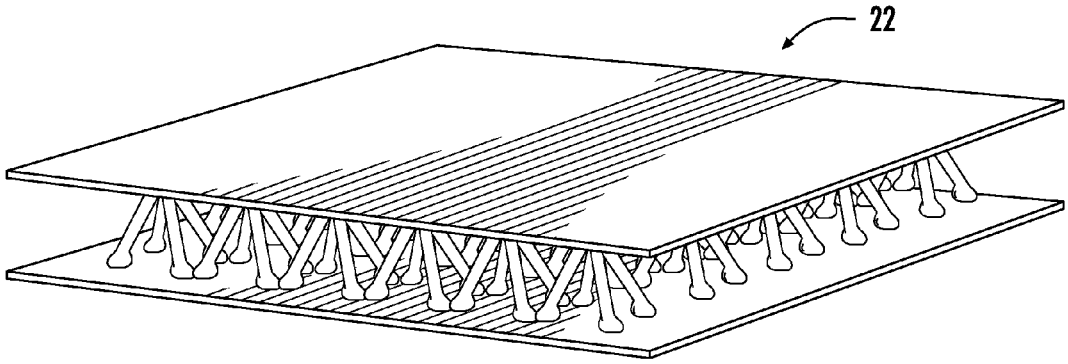
FIG. 7 is a detailed cross-sectional view of the dual wall of FIG. 2 taken at detail 3-3 in FIG. 2 with an alternative compliant structure.
Figure 8:
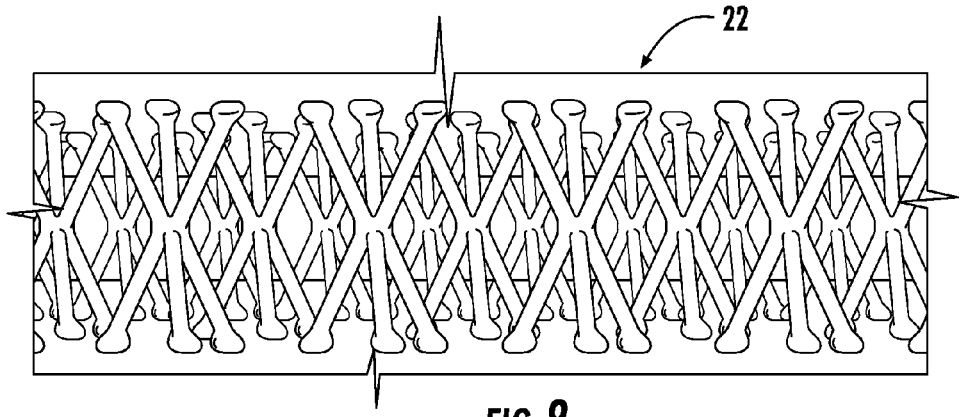
FIG. 8 is a detailed cross-sectional view of the dual wall of FIG. 2 taken at detail 3-3 in FIG. 2 with an alternative compliant structure.
Figure 9:
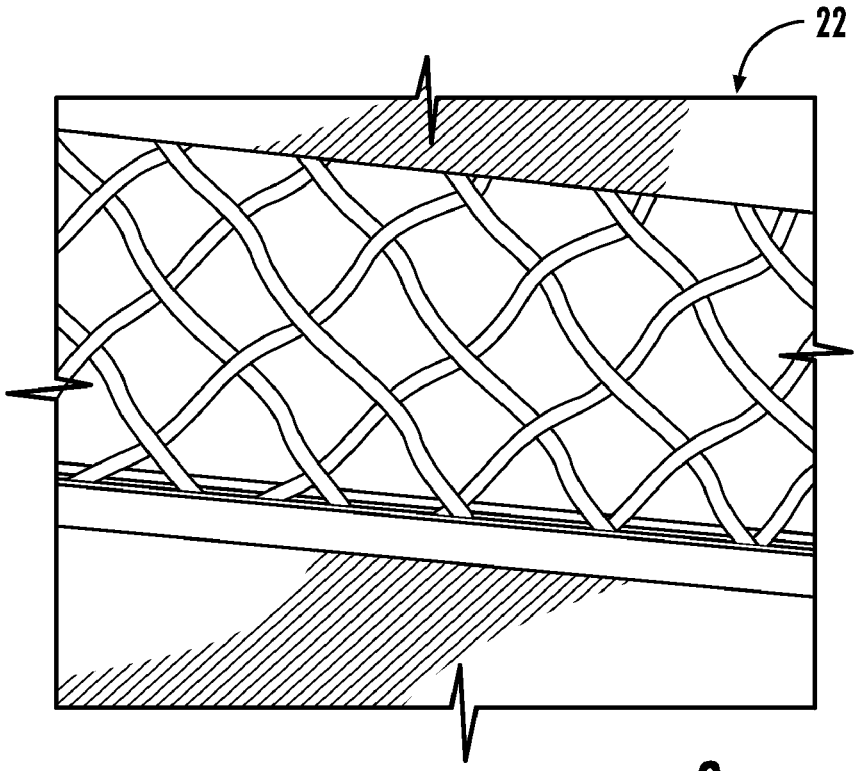
FIG. 9 is a detailed cross-sectional view of the dual wall of FIG. 2 taken at detail 3-3 in FIG. 2 with an alternative compliant structure.
Figure 10:
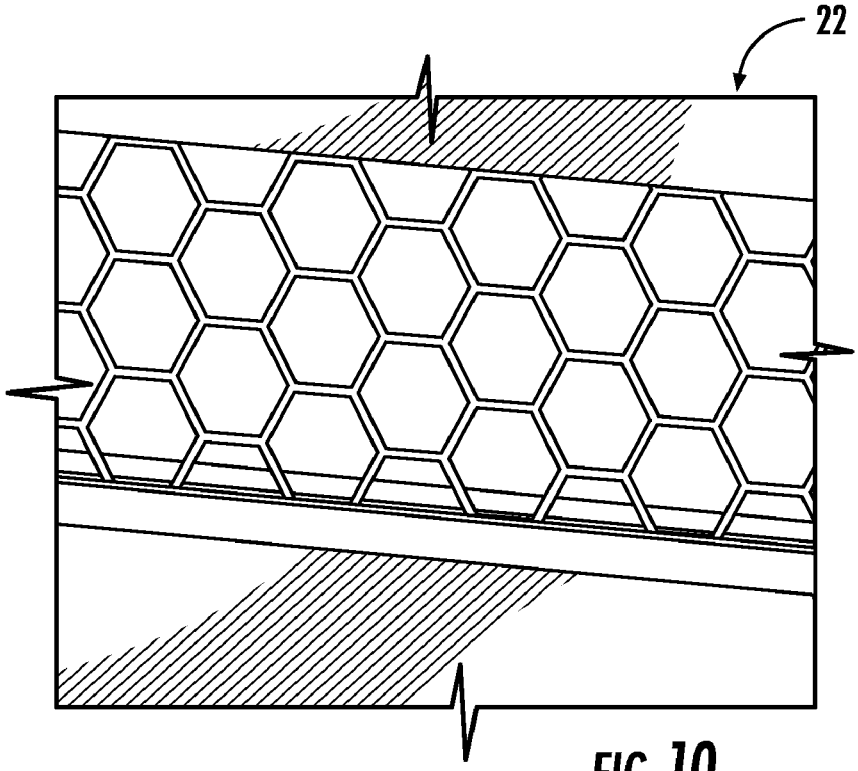
FIG. 10 is a detailed cross-sectional view of the dual wall of FIG. 2 taken at detail 3-3 in FIG. 2 with an alternative compliant structure.

In other embodiments, the compliant structure 22 may be formed from materials capable of providing the necessary support while enabling the outer layer 18 to grow thermally relative to the inner layer 16. As shown in FIG. 7, the compliant structure 22 may be formed from a plurality of pyramidal structures 62. As shown in FIG. 8, the compliant structure 22 may be formed from a plurality of dual inverted pyramidal structures 64. As shown in FIG. 9, the compliant structure 22 may be formed from a honeycomb structure 66. As shown in FIG. 10, the compliant structure 22 may be formed from a woven wire mesh structure 68. As shown in FIG. 11, the compliant structure 22 may be formed from a honeycomb shaped structure 70. The compliant structure 22 may also be formed from structures such as, but not limited to, a lattice truss, a square honeycomb, or a prismatic structure.

During use, the turbine airfoil 10 may be exposed to the hot gases in the hot gas path of the turbine engine. The outer layer 18 of the airfoil 10 heats up and undergoes thermal expansion. The outer layer 18 expands differently than the inner layer 16 because the outer layer 18 is separated from the inner layer 16, thereby allowing the outer layer 18 to become hotter than the inner layer 16. The compliant structure 22 allows the outer layer 18 to move relative to the inner layer 16, thereby preventing the formation of stress within the dual wall 20 between the inner and outer layers 16, 18.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A turbine component, comprising:

an outer dual wall formed from an outer layer and an inner layer separated from the outer layer by a compliant structure that allows the outer and inner layers to move relative to each other thereby reducing the buildup of stress between the layers.

2. The turbine component of claim 1, wherein the turbine component is turbine airfoil formed from a generally elongated hollow airfoil formed from an outer dual wall, and having a leading edge, a trailing edge, a pressure side, a suction side, an outer endwall at a first end, an inner endwall at a second end opposite the first end, and a cooling system positioned in the generally elongated airfoil formed by the outer dual wall.

3. The turbine component of claim 1, wherein the compliant structure is formed from a plurality of pedestals attached to the outer layer and inner layers and extending nonorthogonally and nonparallel between the two layers.

4. The turbine component of claim 3, wherein the pedestals are equally spaced and include feet facilitating attachment to the outer and inner layers.

5. The turbine component of claim 4, wherein the pedestals are positioned generally parallel with each other and at least one of the pedestals includes a first foot attached to a first end of the pedestal and extending in a first direction aligned with the contact surface of the outer layer and a second foot attached to a second end of the pedestal and extending in a second direction aligned with the contact surface of the inner layer.

6. The turbine component of claim 4, wherein at least a portion of the pedestals are positioned at different angles relative to the inner layer thereby creating different thermal growth in distance between the inner layer and the outer layer such that a distance between the outer and inner layers differs along a length of the outer and inner layers.

7. The turbine component of claim 3, wherein the pedestals are formed from a plurality of pyramidal structures.

8. The turbine component of claim 3, wherein the pedestals are formed from a plurality of dual inverted pyramidal structures.

9. The turbine component of claim 3, wherein the pedestals are formed from a honeycomb structure.

10. The turbine component of claim 3, wherein the pedestals are formed from a woven wire mesh structure.

11. The turbine component of claim 1, wherein the pedestals are formed from a honeycomb shaped structure.

12. The turbine component of claim 1, wherein the outer layer is formed from materials selected from the group consisting of PM2000 and MA756 ODS alloys.

13. A turbine airfoil, comprising:

a generally elongated hollow airfoil formed from an outer dual wall, and having a leading edge, a trailing edge, a pressure side, a suction side, an outer endwall at a first end, an inner endwall at a second end opposite the first end, and a cooling system positioned in the generally elongated airfoil formed by the outer dual wall;

wherein the dual wall is formed from an outer layer and an inner layer separated from the outer layer by a compliant structure that allows the outer and inner layers to move relative to each other thereby reducing the buildup of stress between the layers;

wherein the compliant structure is formed from a plurality of pedestals positioned nonorthogonally and nonparallel relative to contact surfaces of the outer and inner layers;

wherein at least one of the pedestals includes a first foot attached to a first end of the pedestal and extending in a first direction aligned with the contact surface of the outer layer and a second foot attached to a second end of the pedestal and extending in a second direction aligned with the contact surface of the inner layer.

14. The turbine airfoil of claim 13, wherein the pedestals are equally spaced and are positioned generally parallel with each other.

15. The turbine airfoil of claim 14, wherein at least a portion of the pedestals are positioned at different angles relative to the inner layer thereby creating different thermal growth in distance between the inner layer and the outer layer such that a distance between the outer and inner layers differs along a length of the outer and inner layers.

16. The turbine airfoil of claim 13, wherein the pedestals are formed from a plurality of pyramidal structures.

17. The turbine airfoil of claim 13, wherein the pedestals are formed from a plurality of dual inverted pyramidal structures.

18. The turbine airfoil of claim 13, wherein the pedestals are formed from a structure selected from the group consisting of a honeycomb structure; a woven wire mesh structure; and a honeycomb shaped structure.

19. The turbine airfoil of claim 13, wherein the outer layer is formed from materials selected from the group consisting of PM2000 and MA756 ODS alloys.

20. A turbine airfoil, comprising:

a generally elongated hollow airfoil formed from an outer dual wall, and having a leading edge, a trailing edge, a pressure side, a suction side, an outer endwall at a first end, an inner endwall at a second end opposite the first end, and a cooling system positioned in the generally elongated airfoil formed by the outer dual wall;

wherein the dual wall is formed from an outer layer and an inner layer separated from the outer layer by a compliant structure that allows the outer and inner layers to move relative to each other thereby reducing the buildup of stress between the layers;

wherein the compliant structure is formed from a plurality of pedestals positioned nonorthogonally and nonparallel relative to contact surfaces of the outer and inner layers;

wherein a portion of the pedestals are positioned generally parallel with each other; and wherein at least one of the pedestals includes a first foot attached to a first end of the pedestal and extending in a first direction aligned with the contact surface of the outer layer and a second foot attached to a second end of the pedestal and extending in a second direction aligned with the contact surface of the inner layer.

* * * * *